US012024389B2

(12) United States Patent
Huang

(10) Patent No.: US 12,024,389 B2
(45) Date of Patent: Jul. 2, 2024

(54) ELECTRIC WATER ACTIVATED GUMMED PAPER TAPE DISPENSER

(71) Applicant: KINGNODE (FUJIAN) TECHNOLOGY CO., LTD., Zhangzhou (CN)

(72) Inventor: Ben Yu Huang, Ningde (CN)

(73) Assignee: KINGNODE (FUJIAN) TECHNOLOGY CO., LTD., Zhangzhou (CN)

( * ) Notice: Subject to any disclaimer, the term of this patent is extended or adjusted under 35 U.S.C. 154(b) by 436 days.

(21) Appl. No.: 17/383,474

(22) Filed: Jul. 23, 2021

(65) Prior Publication Data

US 2022/0204306 A1 Jun. 30, 2022

(30) Foreign Application Priority Data

Dec. 30, 2020 (CN) ..... 202011607560.5

(51) Int. Cl.
*B65H 35/00* (2006.01)

(52) U.S. Cl.
CPC ..... *B65H 35/0046* (2013.01); *B65H 35/0086* (2013.01)

(58) Field of Classification Search
CPC ..... B65H 35/0046; B65H 35/0086
See application file for complete search history.

(56) References Cited

U.S. PATENT DOCUMENTS 5,551,648 A * 9/1996 Vodoor ..... B65H 35/0046 242/615.3
6,474,392 B1 * 11/2002 Lay ..... B65H 35/00 156/577
6,558,467 B1 * 5/2003 Lay ..... B65H 35/0046 118/325
7,987,810 B1 * 8/2011 Gordon ..... B65H 35/0046 118/423
10,308,468 B1 * 6/2019 Wedekind ..... E04F 21/1657
2002/0121169 A1 * 9/2002 LeMoine ..... B26D 7/24 83/575
2012/0090791 A1 * 4/2012 Blanchfield ..... B65H 35/0046 156/510
2014/0026810 A1 * 1/2014 Lazzaroni ..... B65H 35/0046 118/231
2019/0368208 A1 * 12/2019 Wedekind ..... B65H 35/0073
2020/0324428 A1 * 10/2020 Pertile ..... B60P 3/40
2022/0227598 A1 * 7/2022 Endo ..... B65H 35/0086
2023/0057070 A1 * 2/2023 Clarke ..... B65H 35/0066

* cited by examiner

*Primary Examiner* — Omar Flores Sanchez
(74) *Attorney, Agent, or Firm* — Nitin Kaushik

(57) ABSTRACT

The present disclosure relates to the technical field of gummed tape dispensers, and more particularly relates to an electric water activated gummed paper tape dispenser. The dispenser includes a box body, wherein a paper feeding bin, a paper pushing mechanism, a dispensing mechanism, and a paper wetting mechanism are independently arranged according to functions in sequence in the box body, so that the overall structure is simpler, which is conducive to subsequent maintenance. One side of the box body is fixedly connected with an outer hood, a control system is arranged in the outer hood, and the control system is a PLC all-in-one machine. A paper pushing motor of the paper pushing mechanism and a dispensing motor of the dispensing mechanism are both full-digital subdivision stepper driven motors and are controlled by the control system, which is used as a core electronic control part of the device.

11 Claims, 8 Drawing Sheets

ELECTRIC WATER ACTIVATED GUMMED PAPER TAPE DISPENSER

TECHNICAL FIELD

The present disclosure relates to the technical field of gummed tape dispensers, and more particularly relates to an electric water activated gummed paper tape dispenser.

BACKGROUND ART

A gummed tape consists of two parts, i.e. a substrate and an adhesive. It is used to connect two or more unconnected objects together through adhesion. Its surface is coated with a layer of adhesive. Currently, during production of a gummed tape such as a gummed paper tape, a mechanical device is usually used to dispense a gummed paper raw material. However, the existing dispensing apparatus for the gummed paper tape raw material is of complicated structure, not easy to operate and not conducive to maintenance, low in dispensing efficiency and poor in quality, so that it is difficult to meet the requirements of enterprises for dispensing efficiency.

SUMMARY OF THE INVENTION

In view of the above defects in the background art, the present disclosure provides an electric water activated gummed paper tape dispenser.

The present disclosure adopts the following technical solutions:

an electric water activated gummed paper tape dispenser, including a box body internally provided with:

a paper placing bin configured to place a rolled gummed tape, the rolled gummed tape rotating in the paper placing bin;

a paper pushing mechanism including a paper pushing motor, an upper roller, and a lower roller, the upper roller and the lower roller being configured to press the gummed tape, and the paper pushing motor being configured to drive the lower roller to rotate;

a dispensing mechanism including a dispensing motor, an upper dispensing knife, and a lower dispensing knife, the dispensing motor being configured to drive the upper dispensing knife to move relative to the lower dispensing knife; and a wetting mechanism including a water box and a wetting brush, the water box being configured to store water, one end of the wetting brush being located in the water box and the other end of the wetting brush extending out of the water box, wherein the gummed tape is pulled out of the paper placing bin, passes through a gap between the upper roller and the lower roller and the wetting brush in sequence, and extends out of the box body; and a control system which is fixed on the box body controls operation of the dispensing motor and the paper pushing motor.

As a further improvement, the paper placing bin includes an unrolling baffle plate, two adjustment plates, and two carrier rollers, the unrolling baffle plate is fixed in the box body, the two adjustment plates are respectively located at two sides of the unrolling baffle plate; the two carrier rollers are respectively arranged at two sides between the adjustment plates, and two ends of each carrier roller are respectively rotatably connected to two sides of the box body, and the rolled gummed tape is placed on the two carrier rollers.

As a further improvement, the paper placing bin further includes an adjustment screw rod, two ends of the adjustment screw rod are respectively rotatably connected to the two sides of the box body, threaded holes are formed on the adjustment plates, and external threads are formed at two ends of a rod body of the adjustment screw rod, and thread directions of the external threads at the two ends of the adjustment screw rod are opposite, the threaded holes of the two adjustment plates are respectively in threaded connection with the external threads at the two ends of the adjustment screw rod.

As a further improvement, the paper pushing mechanism further includes a main wheel lower bracket and a paper guiding plate upper rack, the gummed tape passes through a gap between the main wheel lower bracket and the paper guiding plate upper rack; two sides of the main wheel lower bracket are respectively fixed to the two sides of the box body, a first through pocket hole is formed on a plane of the main wheel upper bracket, and an upper surface of the lower roller passes through the first pocket hole and is exposed to the plane of the main wheel upper bracket; the paper guiding plate upper rack is located above the main wheel lower bracket, a second through pocket hole is formed on a bottom plane of the paper guiding plate upper rack, and a lower surface of the upper roller passes through the second pocket hole, is exposed to and leans on the lower roller.

As a further improvement, the paper pushing mechanism further includes a press roller mounting rack and a torsional spring, two sides of the press roller mounting rack are respectively rotatably connected to the two sides of the box body, the paper guiding plate upper rack is fixed below the press roller mounting rack, the upper roller is connected to the inside of the press roller mounting rack, and the lower surface of the upper roller passes through the second pocket hole of the paper guiding plate upper rack; the torsional spring is fixed to a bottom of the main wheel lower bracket, one end of the torsional spring passes through the paper guiding plate upper rack and is fixed to the press roller mounting rack, and the other end of the torsional spring is fixedly connected to the main wheel lower bracket.

As a further improvement, an output shaft of the dispensing motor is coaxially fixedly connected with an eccentric wheel, the eccentric wheel is rotatably connected with a transmission rod at an eccentric position, and the other one end, relative to the eccentric wheel, of the transmission rod is rotatably connected to the upper dispensing knife.

As a further improvement, the dispensing mechanism further includes an upper dispensing knife rack, the upper dispensing knife is fixed to the upper dispensing knife rack, vertical strip-shaped holes are formed on two side walls of the box body, two sides of the upper dispensing knife rack are both fixed with a round movable sleeve, the two movable sleeves adaptively penetrate into the two strip-shaped holes; the two sides of the box body are both fixed with a guide rail with an L-shaped section, and the two sides of the upper dispensing knife rack respectively lean against the two guide rails.

As a further improvement, the dispensing mechanism further includes a lower dispensing knife rack and tension springs, the lower dispensing knife is fixed to the lower dispensing knife rack, connecting holes are formed at positions, close to the upper dispensing knife, of the two side walls of the box body, two sides of the lower dispensing knife rack are both provided with a connecting part, the two connecting parts respectively pass through the two connecting holes, and the two connecting parts are fixedly connected with the tension springs, and the other ends, relative to the connecting parts, of the tension springs are fixed to the box body, and the lower dispensing knife is pulled by an elastic force of the tension springs and leans against a side face of the upper dispensing knife.

As a further improvement, the wetting mechanism further includes a wetting press plate, the wetting press plate is arranged on the water box and leans down against the wetting brush, and the gummed tape passes through the wetting brush and the wetting press plate and extends out of the box body.

As a further improvement, the wetting mechanism further includes an upper water tank, the upper water tank is provided with a water guiding nozzle, the water guiding nozzle is connected with a water sealing cover made of a rubber material, an end face of the water sealing cover is provided with a cross notch, the water box includes two accommodating grooves which are communicated with each other, one accommodating groove is configured to place the wetting brush, and the other accommodating groove is fixed to a water diversion rod with a cross-shaped section, and after the upper water tank is placed on the box body, the water diversion rod passes through the notch of the water sealing cover.

It can be seen from the above description of the structure of the present disclosure that compared to the prior art, the present disclosure has the following advantages: according to the present disclosure, the control system controls operation of the paper pushing motor of the paper pushing mechanism so as to control a pushing length of a gummed tape, and controls operation of the dispensing motor of the dispensing mechanism so as to control the dispensing amount of the gummed tape, thereby effectively controlling the quality of the dispensed gummed tape, ensuring convenient operation due to the electric dispensing, and greatly improving the dispensing efficiency. In addition, according to the present disclosure, the paper feeding bin, the paper pushing mechanism, the dispensing mechanism, and the wetting mechanism are independently arranged according to functions in sequence in the box body, so that the overall structure is simpler, which is conducive to subsequent maintenance.

DETAILED DESCRIPTION OF THE INVENTION

Specific implementations of the present disclosure will be described below with reference to the drawings.

An electric water activated gummed paper tape dispenser includes a box body 1 forming an appearance of the dispenser, and a paper placing bin, a paper mechanism, a dispensing mechanism, and a wetting mechanism are arranged in the box body 1.

Figure 1:
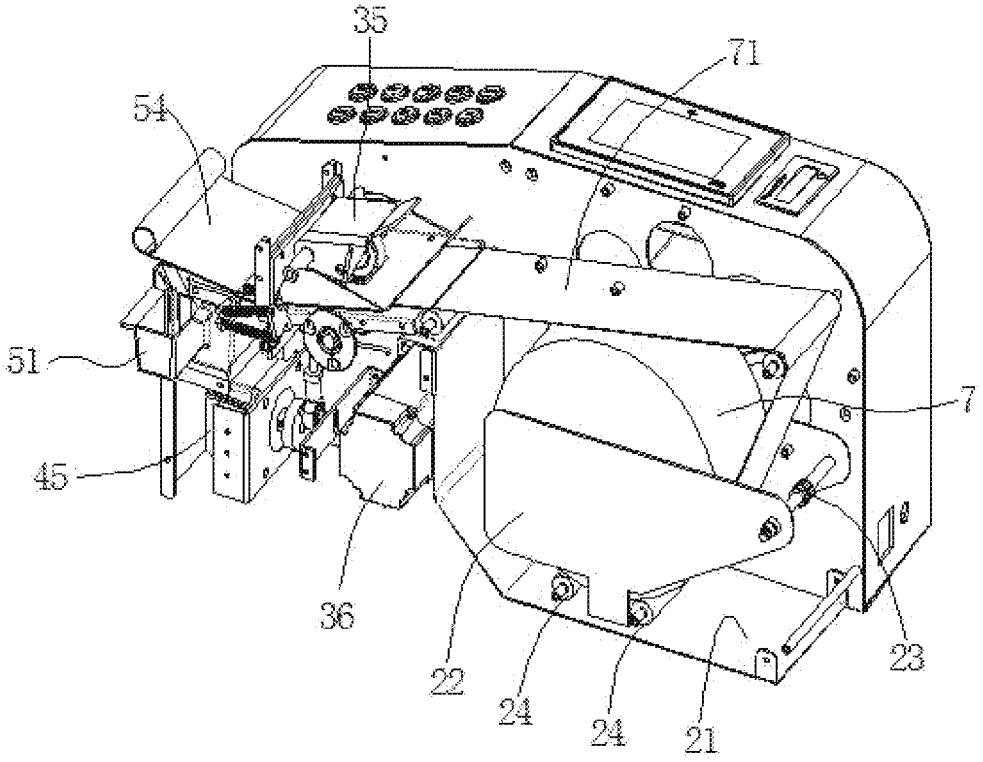
FIG. 1 is a schematic diagram of an internal structure of a box body after one outer hood is hidden of the present disclosure.
Figure 2:
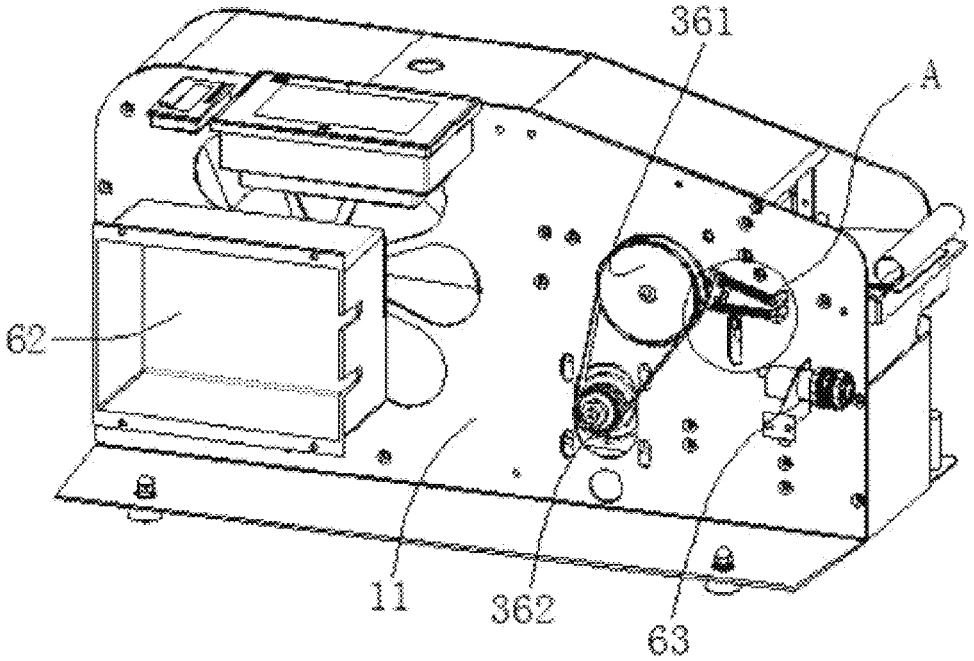
FIG. 2 is a schematic structural diagram of the box body after the other outer hood, relative to the hidden outer hood in FIG. 1, is hidden of the present disclosure.
Figure 5:
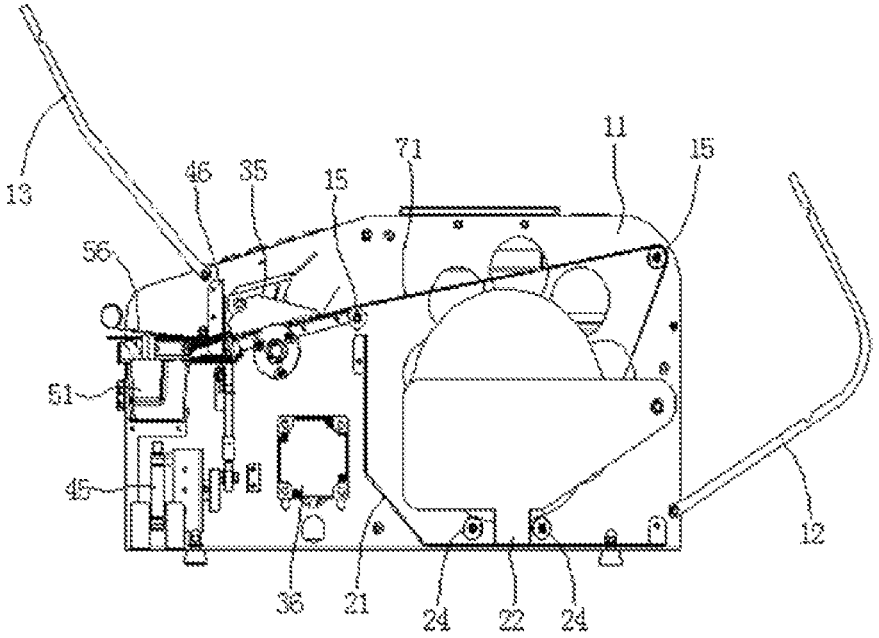
FIG. 5 is a three-dimensional schematic structural diagram of the box body after the first cover plate and the second cover plate are opened.

Referring to FIG. 1 and FIG. 5, the paper placing bin includes an unrolling baffle plate 21, two adjustment plates 22, two carrier rollers 24, and an adjustment screw rod 23. The unrolling baffle plate 21 is fixed in the box body 1, specifically as shown in FIG. 2, the unrolling baffle plate 21 is of L-shaped structure with a bottom used to seal a bottom face of the box body 1 and side parts used to separate from the paper pushing mechanism, the dispensing mechanism, and the wetting mechanism. In conjunction with FIG. 6, two ends of the adjustment screw rod 23 are respectively rotatably connected to two sides of the box body 1, external threads are formed at two ends of a rod body of the adjustment screw rod 23, and thread directions of the external threads at the two ends of the adjustment screw rod 23 are opposite. The two adjustment plates 22 are respectively located at two sides of the unrolling baffle plate 21, and a bottom of each adjustment plate 22 abuts on a bottom face of the unrolling baffle plate 21. The two adjustment plates 22 are both provided with a screw bolt 221, through threaded holes are formed on the screw bolts 221, the threaded holes of the two adjustment plates 22 are respectively in threaded connection with the external threads at the two ends of the adjustment screw rod 23. When the dispenser is used, the two adjustment plates 22 may be moved in opposite directions by rotating the adjustment screw rod 23, so as to expand or reduce a gap between the two adjustment plates 22. With the structure, the present disclosure may be applied to a variety of gummed tapes with different widths, thereby effectively expanding the application scope of the gummed tape dispenser.

Figure 3:
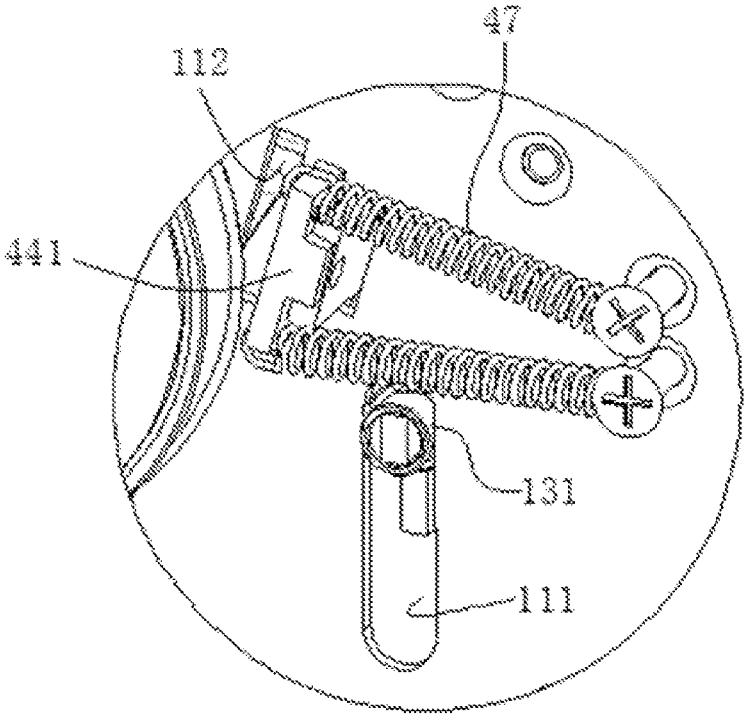
FIG. 3 is an enlarged schematic diagram of A in FIG. 2.
Figure 4:
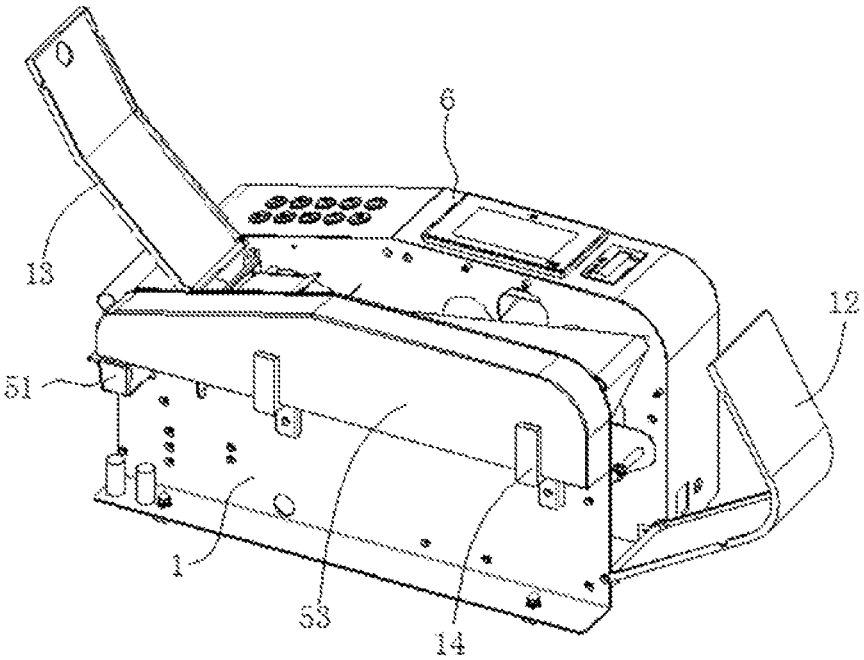
FIG. 4 is a schematic diagram of a side face of an internal structure of the box body after a first cover plate and a second cover plated are opened.
Figure 6:
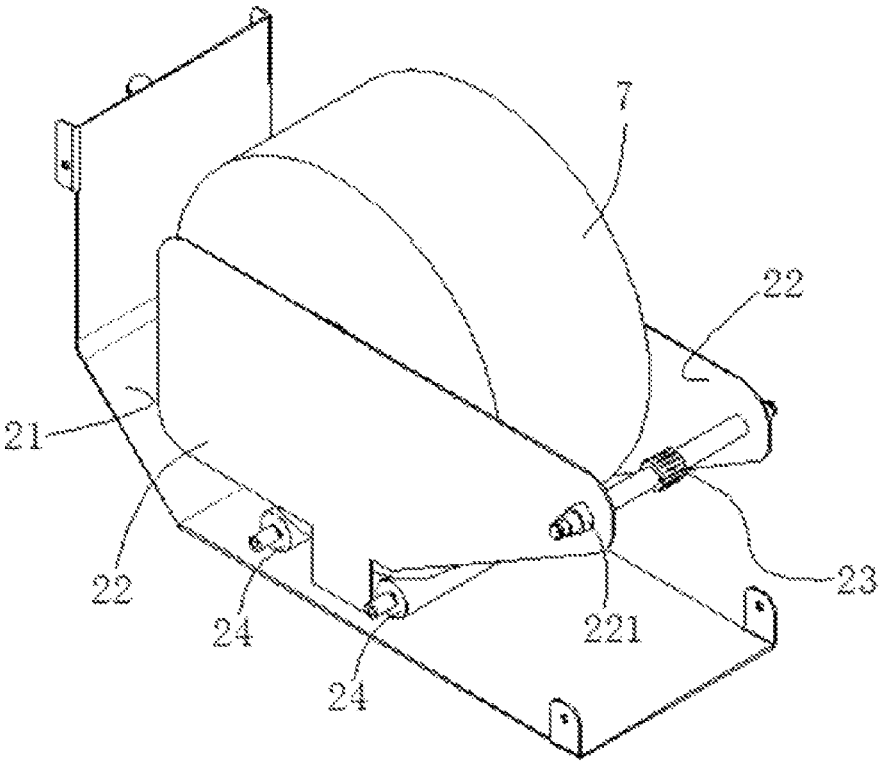
FIG. 6 is a three-dimensional schematic structural diagram of a paper placing bin.

Continuing to refer to FIGS. 1, 5 and 6, the two carrier rollers 24 are respectively arranged at two lower sides between the two adjustment plates 22, two ends of each carrier roller 24 are respectively rotatably connected to the two sides of the box body 1, and a rolled gummed tape is placed on the two carrier rollers 24. As shown in FIGS. 2 and 3, preferably, the box body includes side plates 11 located at the two sides, and a first cover plate 13 and a second cover plate 12 located above and between the two side plates 11, two sides of one end of each of the first cover plate 13 and the second cover plate 12 are respectively rotatably connected to the two side plates 11, so that both the first cover 13 and the second cover plate 12 are of reversibly opened structures. When the rolled gummed tape 71 is placed, the second cover plate 12 is opened, and then the rolled gummed tape 71 is placed in the paper placing bin, so that the two carrier rollers 24 bear the rolled gummed tape 71; the adjustment plates 22 are both moved to a middle position of the adjustment screw rod 23 by rotating the adjustment screw rod 23, so that the two adjustment plates 22 limit the rolled gummed tape 71, when the gummed tape 71 is pulled out, rotation of the rolled gummed tape 71 on the two carrier rollers 24 is limited, which may prevent the smoothness of pulling out of the gummed tape 71 from being affected by shaking of the rolled gummed tape 71.

Figure 7:
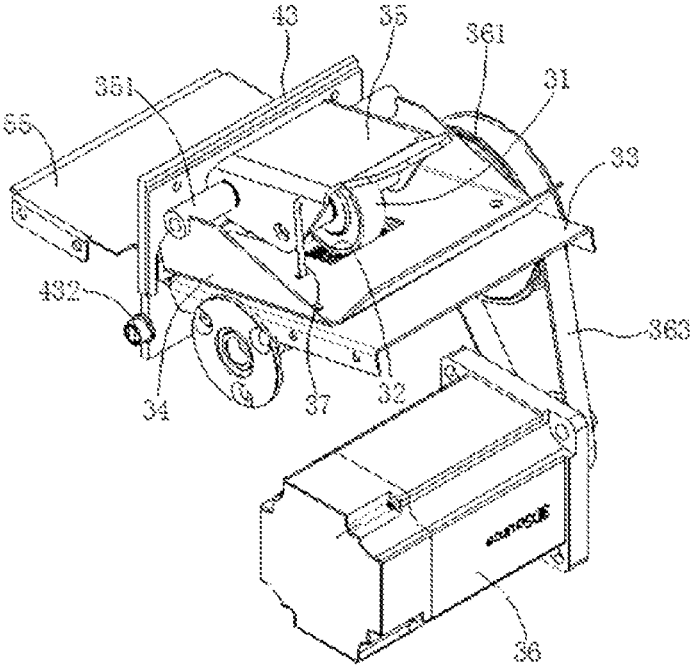
FIG. 7 is a three-dimensional schematic structural diagram of a paper pushing mechanism connected with an upper dispensing knife rack and a paper feeding plate.
Figure 8:
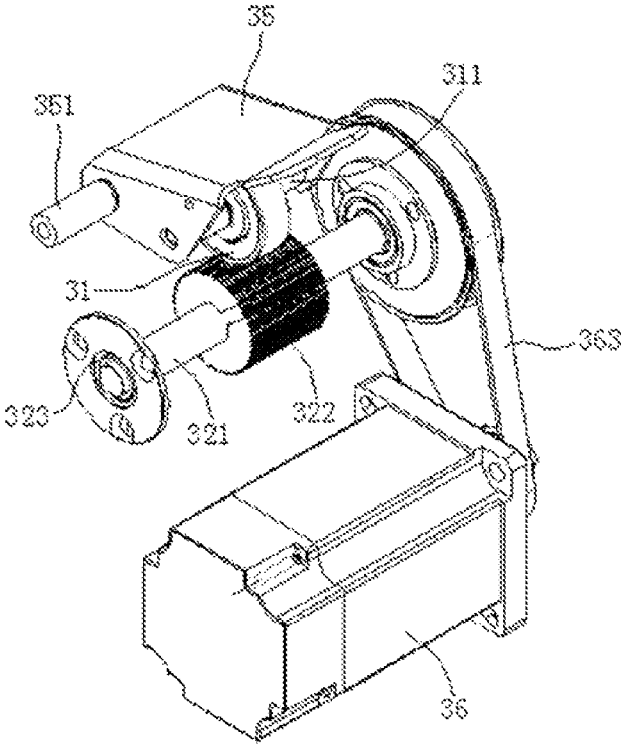
FIG. 8 is a three-dimensional schematic structural diagram of the paper pushing mechanism after a main wheel lower bracket and a paper guiding plate upper rack are hidden.

Referring to FIGS. 7 and 8, the paper pushing mechanism includes a paper pushing motor 36, an upper roller 31, a lower roller 32, a main wheel lower bracket 33, a paper guiding plate upper rack 34, and a press roller mounting rack 35. When the upper roller 31 and the lower roller 32 are used to clamp the gummed tape 71, the paper pushing motor drives the lower roller 32 to rotate. The lower roller 32 includes a rotation shaft 321 and a roller 322 fixed on the rotation shaft 321, knurling is formed on a surface of the roller 322, the two sides (i.e. the two side plates 11) of the box body 1 are both fixed with a bearing 323, two ends of the rotation shaft 321 are respectively fixed to the two bearings 323, and as show in FIGS. 2 and 3, one end of the rotation shaft 321 extends out of the side plate 11 of the box body 1 and is fixedly connected with a transmission wheel 361. The paper pushing motor 36 is fixed in the box body 1, and similarly an output shaft of the paper pushing motor 36 extends out of the box body 1, at the same time, the output shaft of the paper pushing motor 36 is fixedly connected with a driving wheel 362, the driving wheel 362 and the transmission wheel 361 are both synchronous pulleys, and the driving wheel 362 and the transmission wheel 361 are in meshing connection with the same synchronous belt 363, the paper pushing motor 361 drives the lower roller 32 to rotate by means of the transmission of the synchronous belt 363, and the lower roller 32 pushes the gummed tape 71 pressed between the upper roller 31 and the lower roller 32 out under the action of a frictional force generated between the knurling on its surface and the gummed tape 71 when rotating.

Continuing to refer to FIGS. 7 and 8, two sides of the main wheel lower bracket 33 are respectively fixed to the two sides of the box body 1, and a first through pocket hole is formed on a plane of the main wheel lower bracket 33, an upper surface of the lower roller 32 passes through the first pocket hole and is exposed to the plane of the main wheel lower bracket 33, that is, the knurling is exposed to the plane of the main wheel lower bracket 33. In the structure, an upper plane formed by the main wheel lower bracket 33 may bear the gummed tape 71 during the movement. Two sides of the press roller mounting rack 35 are both provided with a fixed shaft 351, the two fixed shafts 351 are respectively rotatably connected to the two sides of the box body 1, and the paper guiding plate upper rack 34 is fixed below the press roller mounting rack 35. The upper roller 31 may be a bearing, a connecting shaft 311 passes through and is fixed to a center of the bearing, and two ends of the connecting shaft are respectively rotatably connected to the two sides of the box body 1. With the structure, the upper roller 31 is restrained to rotate in the press roller mounting rack 35. A second through pocket hole is formed at a bottom plane of the paper guiding plate upper rack 34, and a lower surface of the upper roller 31 passes through the second pocket hole, is exposed to and leans on the lower roller 32. When the dispenser is used, the gummed tape 71 passes through a gap between a bottom plane of the main wheel lower bracket 33 and an upper plane of the paper guiding plate upper rack 34, so that the movement of the gummed tape 71 is further limited, the gummed tape 71 is prevented from being folded along its width direction during the movement, and thus the gummed tape 71 smoothly passes between the upper roller 31 and the lower roller.

Figure 9:
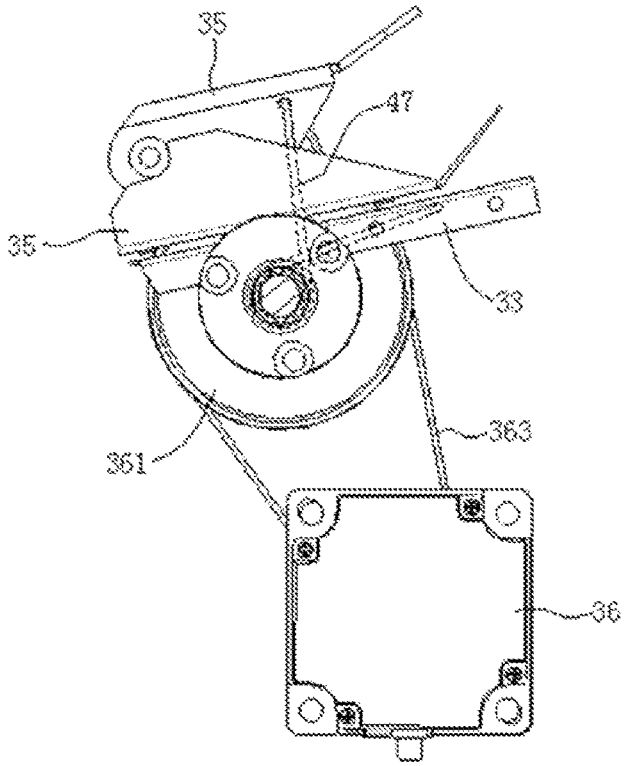
FIG. 9 is a schematic diagram of a side structure of the pushing mechanism (a dotted line represents a torsional spring)

In addition, referring to FIG. 9, the paper pushing mechanism further includes a torsional spring 37 which is fixed to the bottom of the main wheel lower bracket 33, and specifically, a middle of the torsional spring 37 passes through and is sleeved outside the rotations shaft 321 of the lower roller 32. Moreover, one end of the torsional spring 37 passes through the paper guiding plate upper rack 34 and is fastened to one side of the press roller mounting rack 35, so that the end of the torsional spring 37 is relatively fixed to the press roller mounting rack 35, and the other end of the torsional spring 37 directly is pressed up against the bottom of the main wheel lower bracket 33. Because the main wheel lower bracket 33 is of fixed structure relative to the box body 1, when the gummed tape 71 is threaded, the first cover plate 13 may be opened, and then the paper guiding plate upper rack 34 is pulled up to drive the upper roller 3 to move upward so as to form a larger gap between the upper roller 31 and the lower roller 32, which is conducive to the threading of the gummed tape 71, and after the gummed tape 71 is threaded, the paper guiding plate upper rack 34 is released to enable the paper guiding plate upper rack 34 to be pressed downward under an elastic force of the torsional spring 37, so that the upper roller 31 presses the gummed tape 71 down to enable the gummed tape 71 to be fitted with the knurling on the surface of the lower roller 32, which prevents slipping formed between the lower roller 32 and the gummed tape 71 due to a smaller frictional force, thereby ensuring the accuracy of a conveying length of the gummed tape 71.

Figure 10:
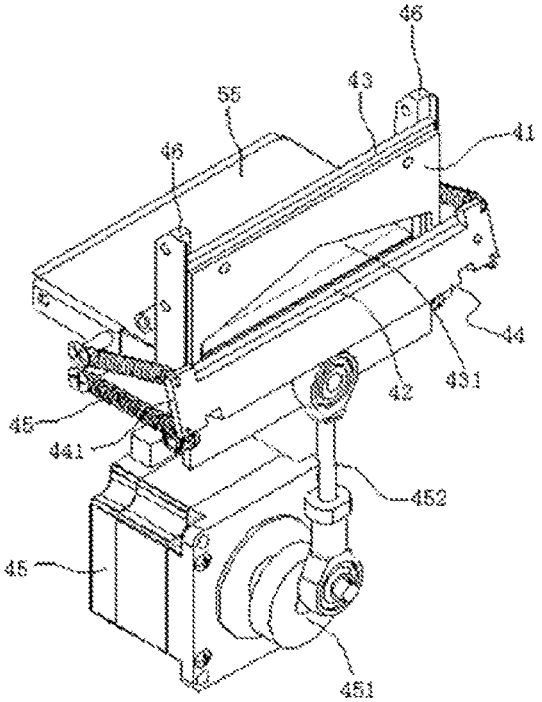
FIG. 10 is a three-dimensional schematic structural diagram of a paper dispensing mechanism.
Figure 11:
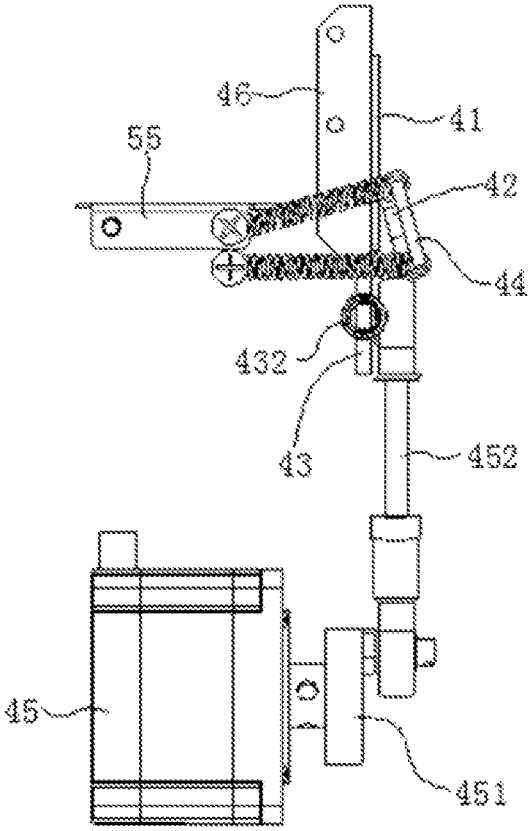
FIG. 11 is a schematic diagram of a side structure of the paper dispensing mechanism.

Referring to FIGS. 10 and 11, the dispensing mechanism includes a dispensing motor 45, an upper dispensing knife 41, a lower dispensing knife 42, an upper dispensing knife rack 43, and a lower dispensing knife rack 44, wherein the upper dispensing knife 41 is fixed to the upper dispensing knife rack 43, and the lower dispensing knife 42 is fixed to the lower dispensing knife rack 44. One through dispensing hole 431 is formed on a surface of the upper dispensing knife rack 43, a blade part of the upper dispensing knife rack 41 is fixed at a top edge position of the dispensing hole 431, the gummed tape 71 passes through the dispensing hole 431, when the upper dispensing knife 41 moves downward relative to the lower dispensing knife 42, the gummed tape 71 is dispensed. In conjunction with FIG. 5, vertical strip-shape holes 111 are formed at the two sides of the box body 1, two sides of the upper dispensing knife rack 43 are both fixed with a round movable sleeve 432, the two movable sleeves adaptively penetrate into the two strip-shaped holes 111, and with the structure, the upper dispensing knife rack 43 can be limited to only vertically move upward and downward and turn over relative to the strip-shaped holes 111. Two internal sides of the box body 1 are both fixed with a guide rail 46 with an L-shaped section, one side face of each guide rail 46 is fixed to the side plate 11 of the box body 1, and the other side face of each guide rail 46 is located at one side, away from the lower dispensing knife 42, of the guide rail 46. The two sides of the upper dispensing knife rack 43 respectively lean against the two guide rails 46, and with the structure, the upper dispensing knife rack 43 can be further limited to vertically move upward and downward and only turn over in a direction of the lower dispensing knife 42.

Continuing to refer to FIG. 3, connecting holes 112 are formed at positions, close to the upper dispensing knife 41, of the two sides of the box body 1, two sides of the lower dispensing knife rack 44 are both provided with a connecting part 441, the two connecting parts 441 respectively pass through the two connecting holes 112, the two connecting parts 441 are fixedly connected with tension springs 47, and the other ends, relative to the connecting parts 441, of the tension springs 47 are fixed to the box body 1, and specifically, are fastened to screws used to fix the box body 1 and connect the wetting mechanism. With the structure, the lower dispensing knife 42 may be pulled by an elastic force of the tension springs 47 at the two sides of the lower dispensing knife 44 and closely leans against a side face of the upper dispensing knife 41, thereby preventing a situation that the gummed tape 71 cannot be accurately dispensed due to a gap between the upper dispensing knife 41 and the lower dispensing knife 42. Further, referring to FIG. 10 again, the upper dispensing knife 41 and the upper dispensing knife rack 43 are both of gantry-shaped structure, and the dispensing hole 431 is formed in the middle, the lower dispensing knife 42 is placed transversely in front of the dispensing hole 431, so that the lower dispensing knife 42 always leans against the side face of the upper dispensing knife 41 closely.

The dispensing motor 45 is fixed in the box body 1, an output shaft of the dispensing motor 45 is coaxially fixedly connected with an eccentric wheel 45, the eccentric wheel 45 is rotatably connected with a transmission rod 452 at an eccentric position, and the other end, relative to the eccentric wheel 451, of the transmission rod 452 is rotatably connected to the upper dispensing knife 41, specifically, the two ends of the transmission rod 452 are connected with knuckle bearings, and connected to the eccentric wheel 451 and the upper dispensing knife rack 43 to realize relative rotation through the knuckle bearings. When the device operates, the dispensing motor 45 drives the eccentric wheel 451 to rotate, and the transmission rod 452 is driven by the rotation of the eccentric wheel 451 to pull the upper dispensing knife track 43 to move upward or downward, so as to realize the dispensing of the gummed tape 71 by the upper dispensing knife 41 and the reset after dispensing.

Figure 12:
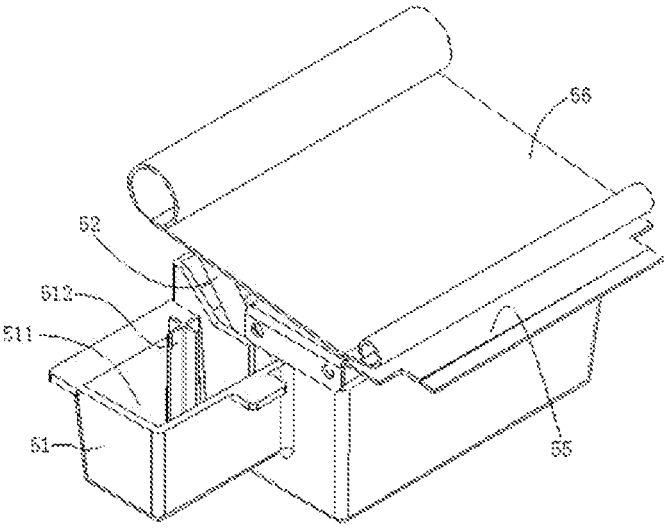
FIG. 12 is a three-dimensional schematic structural diagram of a wetting mechanism after an upper water tank is hidden.
Figure 13:
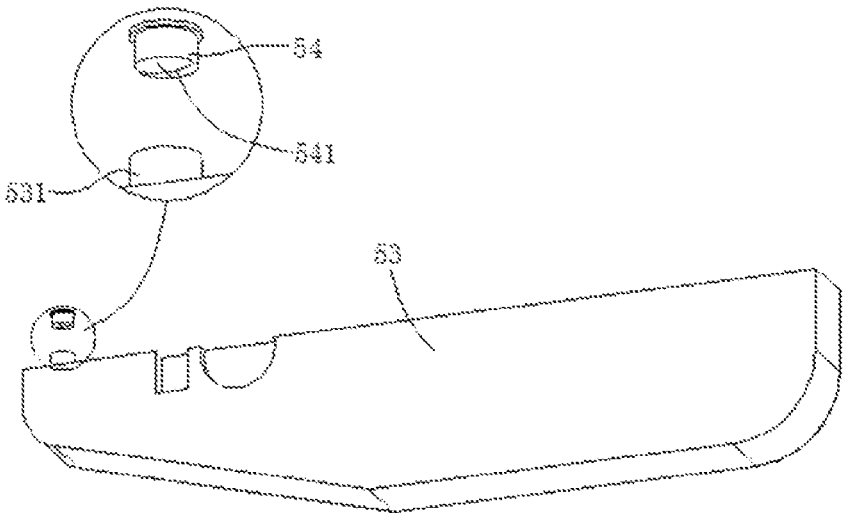
FIG. 13 is a three-dimensional schematic structural diagram of the upper water tank connected with a water sealing plug.
Figure 14:
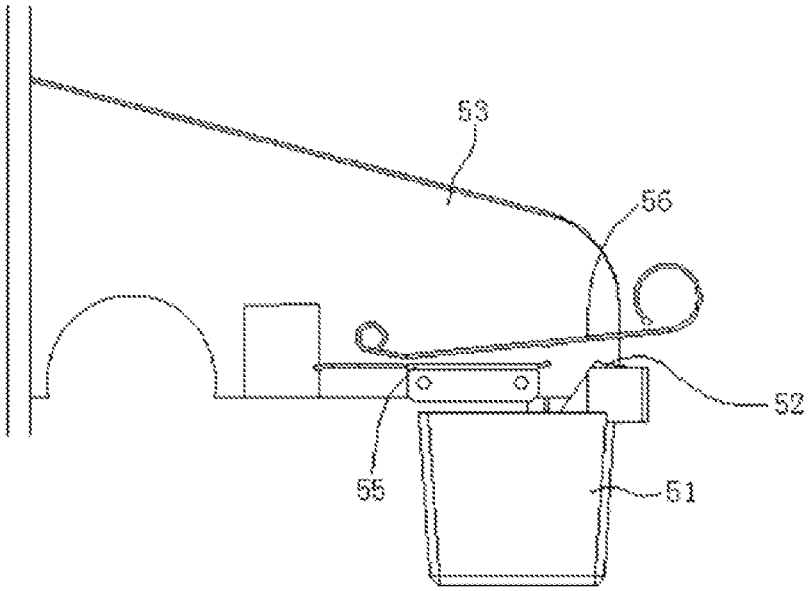
FIG. 14 is a schematic diagram of a side structure of the wetting mechanism.

Referring to FIGS. 12 to 14, the wetting mechanism includes a water box 51, a wetting brush 52, an upper water tank 53, a paper feeding plate 55, and a wetting press plate 56, wherein the wetting brush 52 is made of a water absorbent material, and specifically is made of a material synthesized by PET and PTT artificial fibers. The paper feeding plate 55 and the water box 51 are both fixed in the box body 1, the water box 51 is located below the paper feeding plate 55, the paper feeding plate 55 is engaged with the main wheel lower bracket 33, and the upper dispensing knife rack 43 and the lower dispensing knife rack 44 are located between the paper feeding plate 55 and the main wheel lower bracket 33. The wetting press plate 56 is arranged above the paper feeding plate 55, and is of turnable structure. The water box 51 includes two accommodating grooves 511 which are communicated with each other, one accommodating groove 511 is configured to place the wetting brush 52, and is correspondingly located below the wetting press plate 56, so that water absorbed by the wetting brush 52 may be coated on the gummed tape 71 pushed out by the wetting press plate 56; the other accommodating groove 511 extends out of the box body 1, and a bottom of the accommodating groove 511 extending out of the box body 1 is vertically fixed with a water diversion rod 512 with a cross-shaped section. The upper water tank 53 is provided with a water guiding nozzle 531 which is connected with a water sealing cover made of a rubber material, and an end face of the water sealing cover 54 has a cross-shaped notch 541. External sides of the box body 1 are fixed with two L-shaped brackets 14 which are arranged in a straight line, when the dispenser is used, the upper water tank 53 is directly placed on the two brackets 14, the water guiding nozzle 531 faces downwards, and the water guiding rod 512 is embedded into the notch 541 of the water sealing cover 54.

Continuing to refer to FIGS. 12 to 14, when the dispenser is used, the upper water tank 53 is taken out, the water sealing cover 54 is opened, water is filled into the upper water tank 53 via the water guiding nozzle 531, and then the water sealing cover is closed, the upper water tank 53 is placed on the box body 1, the water diversion rod 512 is correspondingly embedded into the notch 541 of the water sealing cover 54, and the water storage work is completed. Then, because the notch 541 is expanded by the water diversion rod 512, and at the same time, because the water sealing cover 54 is made of a rubber material, it has certain toughness, the notch 541 may be formed into a tiny gap, and water in the upper water tank 53 may flow slowly downward into the accommodating grooves 511 along the water diversion rod 512 from the gap, which is equivalent to that the water in the upper water tank 53 may flow slowly into the water box for a long time, so that the water in the upper water tank 53 can be used for a long time and frequent addition of water can be prevented.

Referring to FIGS. 1 and 5 again, a plurality of reversing rollers 15 are further arranged in the box body, two ends of each reversing roller 15 are respectively rotatably connected to the two sides of the box body 1, through the arrangement of the reversing rollers 15, the gummed tape 71 in the paper placing bin may bypass the various reversing rollers 15 and passes the paper pushing mechanism, the dispensing mechanism, and the wetting mechanism in sequence to form a complete moving routine of the gummed tape 71, which is conducive to the conveying of the gummed tape 71. In addition, according to the present implementation, the two sides of the box body 1 are the side plates 11 at the two sides of the box body 1, and taking the reversing roller 15 as an example, in the present implementation, the rotatable connection structures between the above components and the two sides of the box body 1 may all be that a hinge pin (not shown in the figures) passes through a center of the reversing roller 15, two ends of the hinge pin are respectively fixed to the two side plates, a fixed way is to lock a screw to the hinge pin from the outside of the box body 1 to realize the fixing and limit rotation of the reversing roller or the above rotatably connected components relative to the hinge pin.

Figure 15:
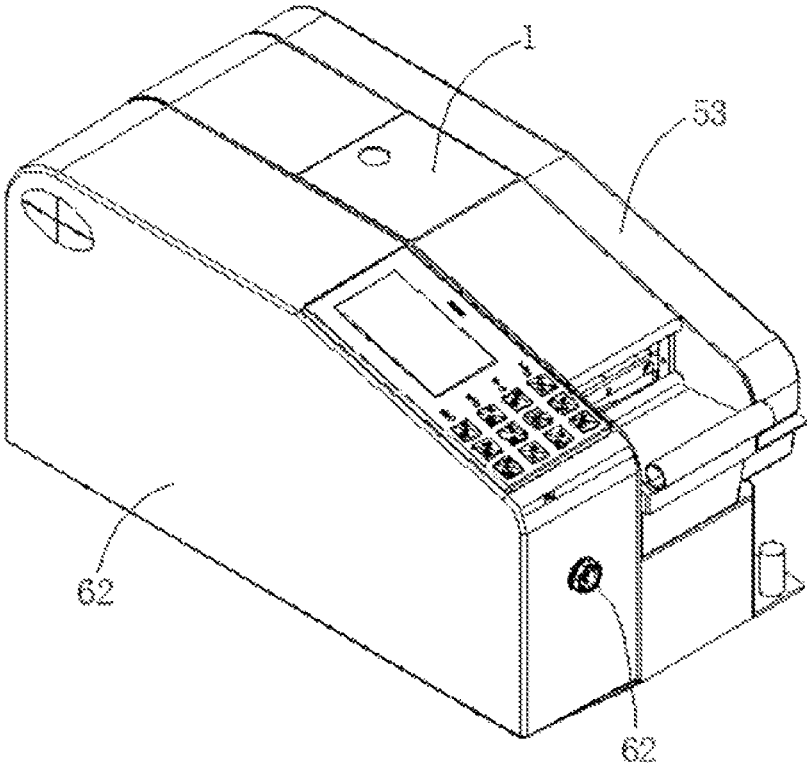
FIG. 15 is a schematic diagram of another embodiment of keys of present disclosure.

One side of the box body 1 is further fixedly connected with an outer hood 6, a control system is arranged in the outer hood 6, and the control system may be a PLC all-in-one machine. The paper pushing motor 36 and the dispensing motor 45 are both full-digital subdivision stepper driven motors and are controlled by the control system, which is used as a core electronic control part of the device, and is convenient for a user to control a pushing length of the gummed tape 71 by controlling the paper pushing motor 36, and to control a dispensing length by controlling the dispensing motor 45, thereby easily realizing the setting of the length and the number of the gummed tape 71 and greatly improving the working efficiency. A memory is arranged in the control system, and the memory is configured to store length data of a variety of gummed tapes 71 of different length specifications, at the same time, keys corresponding to the stored specifications are further arranged at the outside of the outer hood 6, for an example, as shown in FIG. 15, a plurality of keys are arranged on a surface of the outer hood 6, and each key may respectively correspond to one different preset specification. When the dispenser is used, one dispensing specification is selected and set by directly triggering a corresponding key, and through the operating way, one-key-one-specification setting may be easily realized, which is very flexible and convenient, and effectively meets the requirements of users for gummed tapes 71 of various specifications. In addition, the memory adds recording functions such as the number of dispensing, total meters of a gummed tape, a daily total, and required amount setting, so that the user may more easily realize data recording and device quality tracking, the requirements of production and operation can be met, and the waste of a gummed tape can be reduced. Further, the control system is further provided with a time relay which is configured to control timing operation of the paper pushing motor 36 and the dispensing motor 45, so that the user may perform timing dispensing according to an operating speed and a feeding speed of a gummed tape.

One internal side, close to the wetting mechanism, of the outer hood 6 is further fixed with a photoelectric sensor which is connected to the control system via a signal, and the control system controls operation of the dispensing motor 45 after receiving the signal of the photoelectric sensor 63. During operation, a signal of the photoelectric sensor 63 is triggered by blocking the photoelectric sensor 63 with a hand, so that the user senses it once with the hand, and the control system performs one dispensing according to the signal. The operating way is very convenient.

In addition, a battery container 62 is arranged in the outer hood 6, a high-capacity battery pack may be configured in the battery container 62, so that users can conveniently move, flexible operation in places where a power supply is inconvenient to obtain is realized, work progress is not affected in the case of a power failure, and effective utilization rate of the device is improved.

Based on the above, according to the present disclosure, the control system controls operation of the paper pushing motor 36 of the paper pushing mechanism so as to control the pushing length of the gummed tape 71, and controls operation of the dispensing motor 45 of the dispensing mechanism so as to control the dispensing amount of the gummed tape 71, thereby easily realizing setting of length and amount of the gummed tape 71 and greatly improving the dispensing efficiency.

The above are merely specific implementations of the present disclosure, but the design concept of the present disclosure is not limited thereto, any non-substantial modification made to the present invention by using the concept shall be an act that violates the scope of protection of the present disclosure.

What is claimed is:

1. An electric water activated gummed paper tape dispenser, comprising a box body internally provided with:

a paper placing bin configured to place a rolled gummed tape, the rolled gummed tape rotating in the paper placing bin;

a paper pushing mechanism comprising a paper pushing motor, an upper roller, and a lower roller, the upper roller and the lower roller being configured to press the gummed tape, and the paper pushing motor being configured to drive the lower roller to rotate;

a dispensing mechanism comprising a dispensing motor, an upper dispensing knife, and a lower dispensing knife, the dispensing motor being configured to drive the upper dispensing knife to move relative to the lower dispensing knife; and a wetting mechanism comprising a water box and a wetting brush, the water box being configured to store water, one end of the wetting brush being located in the water box and the other end of the wetting brush extending out of the water box, wherein the gummed tape is pulled out of the paper placing bin, passes through a gap between the upper roller and the lower roller and the wetting brush in sequence, and extends out of the box body; and a control system which is fixed on the box body controls operation of the dispensing motor and the paper pushing motor;

wherein the paper placing bin comprises an unrolling baffle plate, two adjustment plates, and two carrier rollers, the unrolling baffle plate is fixed in the box body, the two adjustment plates are respectively located at two sides of the unrolling baffle plate; the two carrier rollers are respectively arranged at two sides between the adjustment plates, and two ends of each carrier roller are respectively rotatably connected to two sides of the box body, and the rolled gummed tape is placed on the two carrier rollers.

2. The electric water activated gummed paper tape dispenser according to claim 1, wherein the paper placing bin further comprises an adjustment screw rod, two ends of the adjustment screw rod are respectively rotatably connected to the two sides of the box body, the adjustment plates are provided with threaded holes, and external threads are formed at two ends of a rod body of the adjustment screw rod, and thread directions of the external threads at the two ends of the adjustment screw rod are opposite, the threaded holes of the two adjustment plates are respectively in threaded connection with the external threads at the two ends of the adjustment screw rod.

3. The electric water activated gummed paper tape dispenser according to claim 1, wherein the paper pushing mechanism further comprises a main wheel lower bracket and a paper guiding plate upper rack, the gummed tape passes through a gap between the main wheel lower bracket and the paper guiding plate upper rack; two sides of the main wheel lower bracket are respectively fixed to the two sides of the box body, a first through pocket hole is formed on a plane of the main wheel upper bracket, and an upper surface of the lower roller passes through the first pocket hole and is exposed to the plane of the main wheel upper bracket; the paper guiding plate upper rack is located above the main wheel lower bracket, a second through pocket hole is formed on a bottom plane of the paper guiding plate upper rack, and a lower surface of the upper roller passes through the second pocket hole, is exposed to and leans on the lower roller.

4. The electric water activated gummed paper tape dispenser according to claim 3, wherein the paper pushing mechanism further comprises a press roller mounting rack and a torsional spring, two sides of the press roller mounting rack are respectively rotatably connected to the two sides of the box body, the paper guiding plate upper rack is fixed below the press roller mounting rack, the upper roller is connected to the press roller mounting rack, and the lower surface of the upper roller passes through the second pocket hole of the paper guiding plate upper rack; the torsional spring is fixed to a bottom of the main wheel lower bracket, one end of the torsional spring passes through the paper guiding plate upper rack and is fixed to the press roller mounting rack, and the other end of the torsional spring is fixedly connected to the main wheel lower bracket.

5. The electric water activated gummed paper tape dispenser according to claim 1, wherein an output shaft of the dispensing motor is coaxially fixedly connected with an eccentric wheel, the eccentric wheel is rotatably connected with a transmission rod at an eccentric position, and the other one end, relative to the eccentric wheel, of the transmission rod is rotatably connected to the upper dispensing knife.

6. The electric water activated gummed paper tape dispenser according to claim 5, wherein the dispensing mechanism further comprises an upper dispensing knife rack, the upper dispensing knife is fixed to the upper dispensing knife rack, vertical strip-shaped holes are formed on two side walls of the box body, two sides of the upper dispensing knife rack are both fixed with a round movable sleeve, and the two movable sleeves adaptively penetrate into the two strip-shaped holes; the two sides of the box body are both fixed with a guide rail with an L-shaped section, and the two sides of the upper dispensing knife rack respectively lean against the two guide rails.

7. The electric water activated gummed paper tape dispenser according to claim 5, wherein the dispensing mechanism further comprises a lower dispensing knife rack and tension springs, the lower dispensing knife is fixed to the lower dispensing knife rack, connecting holes are formed at positions, close to the upper dispensing knife, of the two side walls of the box body, two sides of the lower dispensing knife rack are both provided with a connecting part, the two connecting parts respectively pass through the two connecting holes, and the two connecting parts are fixedly connected with the tension springs, and the other ends, relative to the connecting parts, of the tension springs are fixed to the box body, and the lower dispensing knife is pulled by an elastic force of the tension springs and leans against a side face of the upper dispensing knife.

8. The electric water activated gummed paper tape dispenser according to claim 1, wherein the wetting mechanism further comprises a wetting press plate, the wetting press plate is arranged on the water box and leans down against the wetting brush, and the gummed tape passes through the wetting brush and the wetting press plate and extends out of the box body.

9. The electric water activated gummed paper tape dispenser according to claim 1, wherein the wetting mechanism further comprises an upper water tank, the upper water tank is provided with a water guiding nozzle which is connected with a water sealing cover made of a rubber material, an end face of the water sealing cover has a cross-shaped notch, the water box comprises two accommodating grooves which are communicated with each other, one accommodating groove is configured to place the wetting brush, and the other accommodating groove is fixed to a water diversion rod with a cross-shaped section, and after the upper water box is placed on the box body, the water diversion rod passes through the notch of the water sealing cover.

10. An electric water activated gummed paper tape dispenser, comprising a box body internally provided with:

a paper placing bin configured to place a rolled gummed tape, the rolled gummed tape rotating in the paper placing bin;

a paper pushing mechanism comprising a paper pushing motor, an upper roller, and a lower roller, the upper roller and the lower roller being configured to press the gummed tape, and the paper pushing motor being configured to drive the lower roller to rotate;

a dispensing mechanism comprising a dispensing motor, an upper dispensing knife, and a lower dispensing knife, the dispensing motor being configured to drive the upper dispensing knife to move relative to the lower dispensing knife; and a wetting mechanism comprising a water box and a wetting brush, the water box being configured to store water, one end of the wetting brush being located in the water box and the other end of the wetting brush extending out of the water box, wherein the gummed tape is pulled out of the paper placing bin, passes through a gap between the upper roller and the lower roller and the wetting brush in sequence, and extends out of the box body; and a control system which is fixed on the box body controls operation of the dispensing motor and the paper pushing motor;

wherein the paper pushing mechanism further comprises a main wheel lower bracket and a paper guiding plate upper rack, the gummed tape passes through a gap between the main wheel lower bracket and the paper guiding plate upper rack; two sides of the main wheel lower bracket are respectively fixed to the two sides of the box body, a first through pocket hole is formed on a plane of the main wheel upper bracket, and an upper surface of the lower roller passes through the first pocket hole and is exposed to the plane of the main wheel upper bracket; the paper guiding plate upper rack is located above the main wheel lower bracket, a second through pocket hole is formed on a bottom plane of the paper guiding plate upper rack, and a lower surface of the upper roller passes through the second pocket hole, is exposed to and leans on the lower roller.

11. An electric water activated gummed paper tape dispenser, comprising a box body internally provided with:

a paper placing bin configured to place a rolled gummed tape, the rolled gummed tape rotating in the paper placing bin;

a paper pushing mechanism comprising a paper pushing motor, an upper roller, and a lower roller, the upper roller and the lower roller being configured to press the gummed tape, and the paper pushing motor being configured to drive the lower roller to rotate;

a dispensing mechanism comprising a dispensing motor, an upper dispensing knife, and a lower dispensing knife, the dispensing motor being configured to drive the upper dispensing knife to move relative to the lower dispensing knife; and a wetting mechanism comprising a water box and a wetting brush, the water box being configured to store water, one end of the wetting brush being located in the water box and the other end of the wetting brush extending out of the water box, wherein the gummed tape is pulled out of the paper placing bin, passes through a gap between the upper roller and the lower roller and the wetting brush in sequence, and extends out of the box body; and a control system which is fixed on the box body controls operation of the dispensing motor and the paper pushing motor;

wherein an output shaft of the dispensing motor is coaxially fixedly connected with an eccentric wheel, the eccentric wheel is rotatably connected with a transmission rod at an eccentric position, and the other one end, relative to the eccentric wheel, of the transmission rod is rotatably connected to the upper dispensing knife.

* * * * *